US008309212B2

(12) United States Patent
Vandura et al.

(10) Patent No.: US 8,309,212 B2
(45) Date of Patent: Nov. 13, 2012

(54) CERAMIC FIBER MODULES

(75) Inventors: Joe Vandura, Huntersville, NC (US); Victor J. O'Block, Granger, IN (US); Jenna Garr, Inola, OK (US); Daryl Pickett, Pryor, OK (US)

(73) Assignee: A.P. Green Industries, Inc., Moon Township, PA (US)

( * ) Notice: Subject to any disclaimer, the term of this patent is extended or adjusted under 35 U.S.C. 154(b) by 554 days.

(21) Appl. No.: 12/494,925

(22) Filed: Jun. 30, 2009

(65) Prior Publication Data

US 2010/0326009 A1 Dec. 30, 2010

(51) Int. Cl.
*B32B 7/08* (2006.01)

(52) U.S. Cl. ..... 428/223; 52/745.21; 52/747.13

(58) Field of Classification Search ..... 428/223; 52/745.21, 747.13
See application file for complete search history.

(56) References Cited

U.S. PATENT DOCUMENTS

| | | | | |
|---|---|---|---|---|
| 3,819,468 | A | 6/1974 | Sauder et al. | 161/152 |
| 4,001,996 | A | 1/1977 | Byrd, Jr. | 52/509 |
| 4,123,886 | A | 11/1978 | Byrd, Jr. | 52/509 |
| 4,803,822 | A * | 2/1989 | Deren | 52/506.02 |
| 4,943,465 | A * | 7/1990 | Bailey et al. | 428/102 |
| RE33,463 | E | 11/1990 | Sauder et al. | 428/99 |
| 5,353,567 | A | 10/1994 | Knight et al. | 52/506.03 |
| 6,168,362 | B1 * | 1/2001 | Tucker et al. | 411/442 |

OTHER PUBLICATIONS

Brochure entitled: "Inswool® Ceramic Fiber Modules System," ©2007, Harbison-Walker Refractories Company, 4 pages.

* cited by examiner

*Primary Examiner* — Elizabeth Cole
(74) *Attorney, Agent, or Firm* — Kusner & Jaffe

(57) ABSTRACT

An insulating block for lining an interior surface of a furnace wall. The block is comprised of at least two insulating module sections. Each module section is formed from two or more layers of a ceramic (material) blanket. The layers of the ceramic blanket are held together by one or more plastic fasteners, each plastic fastener comprised of an elongated fiber portion that is dimensioned to extend at least partially through at least two of the layers and enlarged end sections dimensioned to engage the layers. The layers of the blanket are held together side-by-side by the plastic fasteners. A support member has at least one anchor rod (tube) affixed thereto. The insulating module sections are mounted on the anchor rod.

21 Claims, 9 Drawing Sheets

CERAMIC FIBER MODULES

FIELD OF THE INVENTION

The present invention relates generally to refractory linings for high-temperature furnace applications and, more particularly, to a refractory fiber module and a method of forming the same.

BACKGROUND OF THE INVENTION

It is known to use refractory ceramic mats or blankets made from fibrous, refractory materials to line the interior of high-temperature furnaces. The refractory fiber blankets are often assembled into cube-shaped "modules" formed from a plurality of individual layers of a refractory ceramic fiber blanket. U.S. Pat. Nos. 4,001,996, 5,353,567, and 3,819,468 disclose different types of "modules" formed from layers of refractory material. The layers of refractory material are held together in a number of different ways. For example, U.S. Pat. No. 5,353,567 to Knight et al. discloses layers of refractory material held together by bands that are wrapped around the layers of refractory material. L-shaped members are located at the corners of the module to prevent the bands from compressing and distorting the refractory layers. U.S. Pat. No. 3,819,468 to Sauder et al. discloses a module having multiple refractory layers that are held together by metal wires extending through the refractory layers. The wires are part of a system including U-shaped hairpin-type devices that are used to attach the refractory module to a support structure. U.S. Pat. No. 4,001,996 to Byrd Jr. discloses layers of a refractory fiber blanket held together by needling and a stringer channel member.

Each of the foregoing systems maintains the refractory fiber module in a generally cubic configuration primarily for post-manufacturing handling and shipping.

The cubic modules are typically mounted to the inner surface of a furnace by a support structure embedded within each module. The support structure is mounted onto a support rod that extends from the inner surface of the furnace. During installation, any outer support structure, such as the cardboard panels and bands or plastic coverings, must be removed from the module.

As will be appreciated, wrapping a refractory module within cardboard panels and bands or within a plastic covering during assembly is time-consuming and costly. In addition, removing such panels, bands, and plastic coverings during installation and disposing of such material is also time-consuming and expensive.

The present invention provides a refractory fiber module and a method of assembling a refractory fiber module that overcome the foregoing shortcomings of conventional refractory modules and a method of assembling the same.

SUMMARY OF THE INVENTION

In accordance with the present invention, there is provided an insulating block for lining an interior surface of a furnace wall. The block is comprised of at least two insulating module sections. Each module section is formed from two or more layers of a ceramic (material) blanket. The layers of the ceramic blanket are held together by one or more plastic fasteners, each plastic fastener comprised of an elongated fiber portion that is dimensioned to extend at least partially through at least two of the layers and enlarged end sections dimensioned to engage the layers. The layers of the blanket are held together side-by-side by the plastic fasteners. A support member has at least one anchor rod (tube) affixed thereto. The insulating module sections are mounted on the anchor rod.

In accordance with another aspect of the present invention, there is provided a refractory module formed from two or more layers of a ceramic (material) blanket. The layers of the ceramic blanket are held together by one or more plastic fasteners. Each plastic fastener is comprised of an elongated fiber portion dimensioned to extend at least partially through at least two of the layers and enlarged end sections. The fiber portion has a predetermined length wherein the layers of the blanket are held together side-by-side by the plastic fasteners.

In accordance with yet another aspect of the present invention, there is provided an insulating block for lining an interior surface of a furnace wall. The block is comprised of a support member having at least one elongated anchor rod attached thereto. A plurality of layers of a ceramic blanket is mounted on the anchor rod. The layers are held together side-by-side by one or more plastic fasteners. Each plastic fastener is comprised of an elongated fiber portion that is dimensioned to extend at least partially through at least two of the ceramic layers and enlarged end sections dimensioned to engage the layers.

In accordance with still another aspect of the present invention, there is provided a method of assembling a refractory module from layers of a ceramic material, comprising the steps of:

assembling like-sized layers of a ceramic material together side-by-side;

securing the layers together into a module section by forcing elongated plastic fasteners through the layers of material. Each of the fasteners has an elongated fiber portion dimensioned to extend at least partially through at least two layers and enlarged end sections. The layers of ceramic material are held together side-by-side by the enlarged end sections capturing the layers.

An advantage of the present invention is a refractory fiber module for lining the inner surface of a furnace.

Another advantage of the present invention is a refractory fiber module that does not require plastic coverings, glue or cardboard panels and bands to maintain the modules in an assembled configuration.

Another advantage of the present invention is a module as described above that reduces waste material by eliminating the need for plastic or metal bands, cardboard panels and plastic coverings to maintain the shape of the module.

Another advantage of the present invention is a refractory fiber module that can be easily assembled and held together at a lower cost.

Another advantage of the present invention is a refractory fiber module having plastic fasteners that extend through layers of a ceramic fiber material to secure the layers together.

Another advantage of the present invention is a refractory fiber module, as described above, wherein the fasteners may remain within the module during installation and use of the module.

Another advantage of the present invention is a refractory fiber module that does not include metal wires or clips to hold the layers of ceramic fiber material together, thereby reducing the potential of injury to workers during mounting of the fiber modules in a furnace and removal of the modules therefrom.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
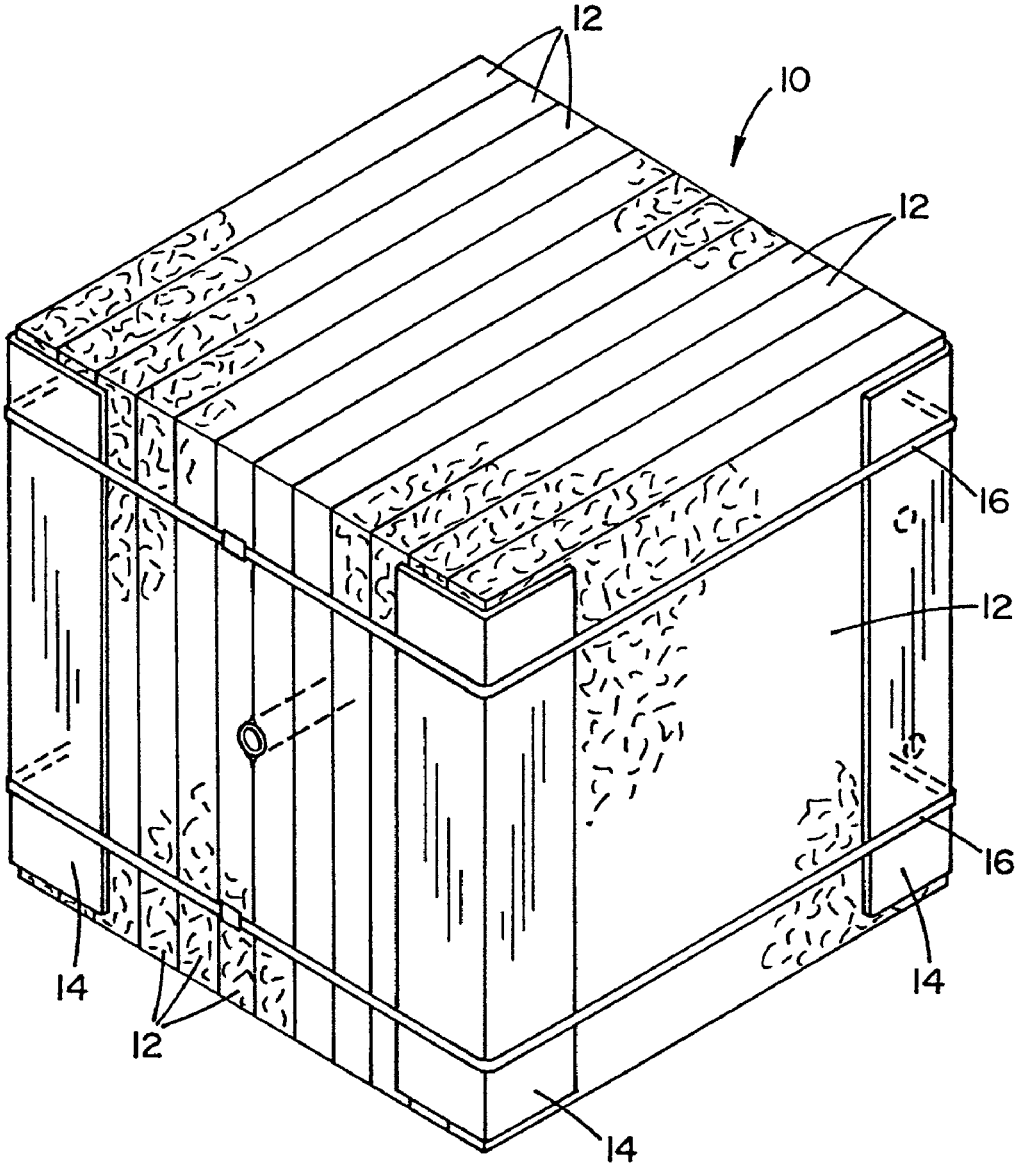
FIG. 1 (PRIOR ART)
FIG. 1 is a perspective view of a prior-art, refractory module held together by cardboard panels and bands extending around the module.

Referring now to the drawings wherein the showings are for the purpose of illustrating a preferred embodiment of the invention only and not for the purpose of limiting same, FIG. 1 shows a conventional, refractory fiber module 10 comprised of a plurality of like-shaped layers 12 of a refractory mat or blanket. Refractory layers 12 are mounted onto a support structure that is partially shown in FIG. 1. The assembled layers 12 form a generally cubic refractory module. To hold the refractory layers together for shipping, cardboard panels 14, having L-shaped cross sections, are disposed at the corners of refractory module 10. Metallic or plastic bands 16 surround refractory layers 12 and cardboard panels 14 to maintain the cube-like configuration of module 10 during shipping.

Figure 2:
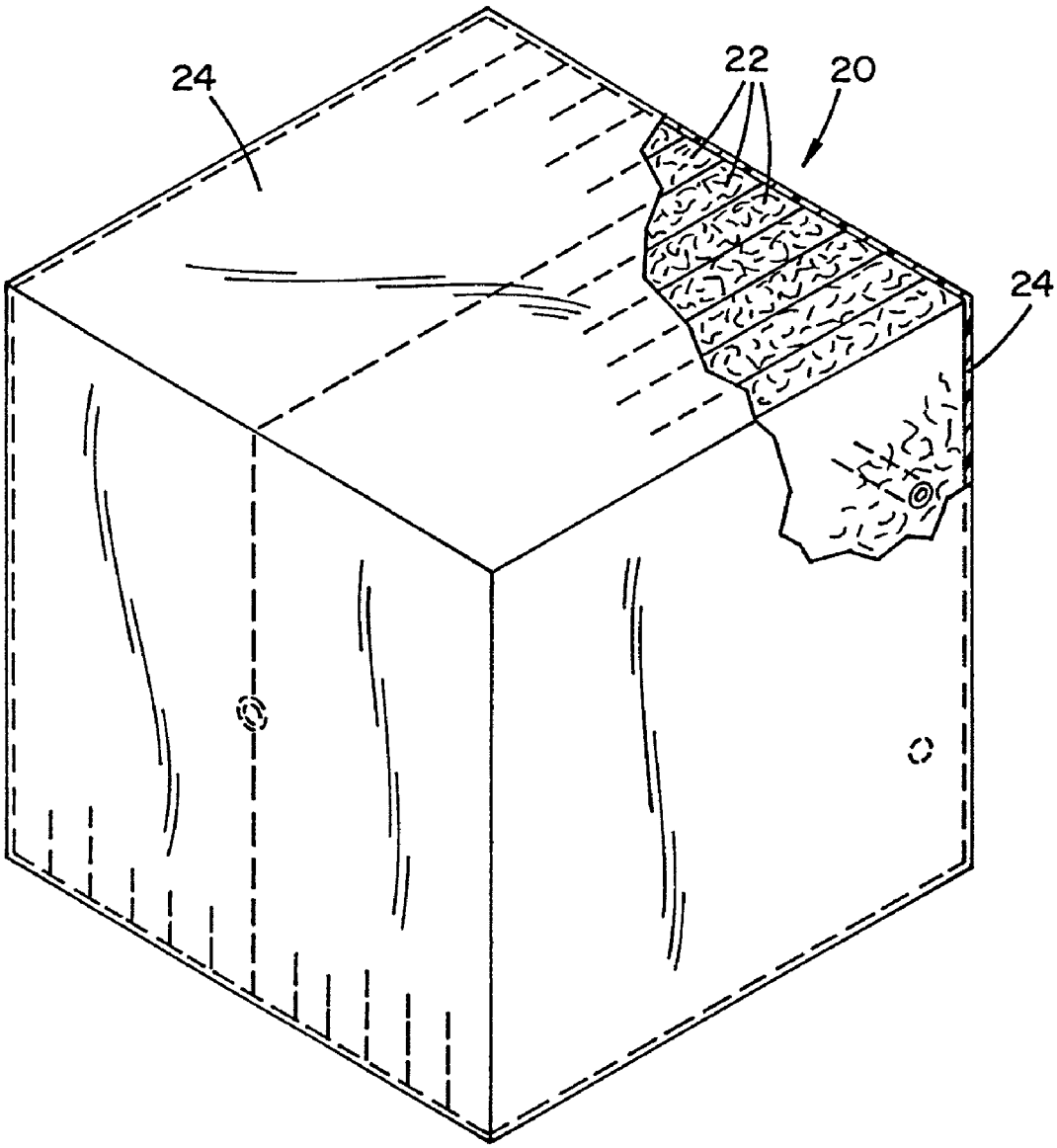
FIG. 2 (PRIOR ART)
FIG. 2 is a perspective view of a prior-art, refractory module, wherein the layers of ceramic material are held together by an outer plastic or polymer covering.

FIG. 2 shows another conventional refractory fiber module 20 wherein refractory layers 22 are held together by a polymer cover 24 surrounding module 20. Modules 10 and 20 shown in FIGS. 1 and 2 are shipped to a job site for installation on an interior surface of a furnace wall. During the installation process, bands 16 and cardboard panels 14 of module 10 and polymer covering 24 of module 20 must be removed prior to operation of the furnace.

Figure 3:
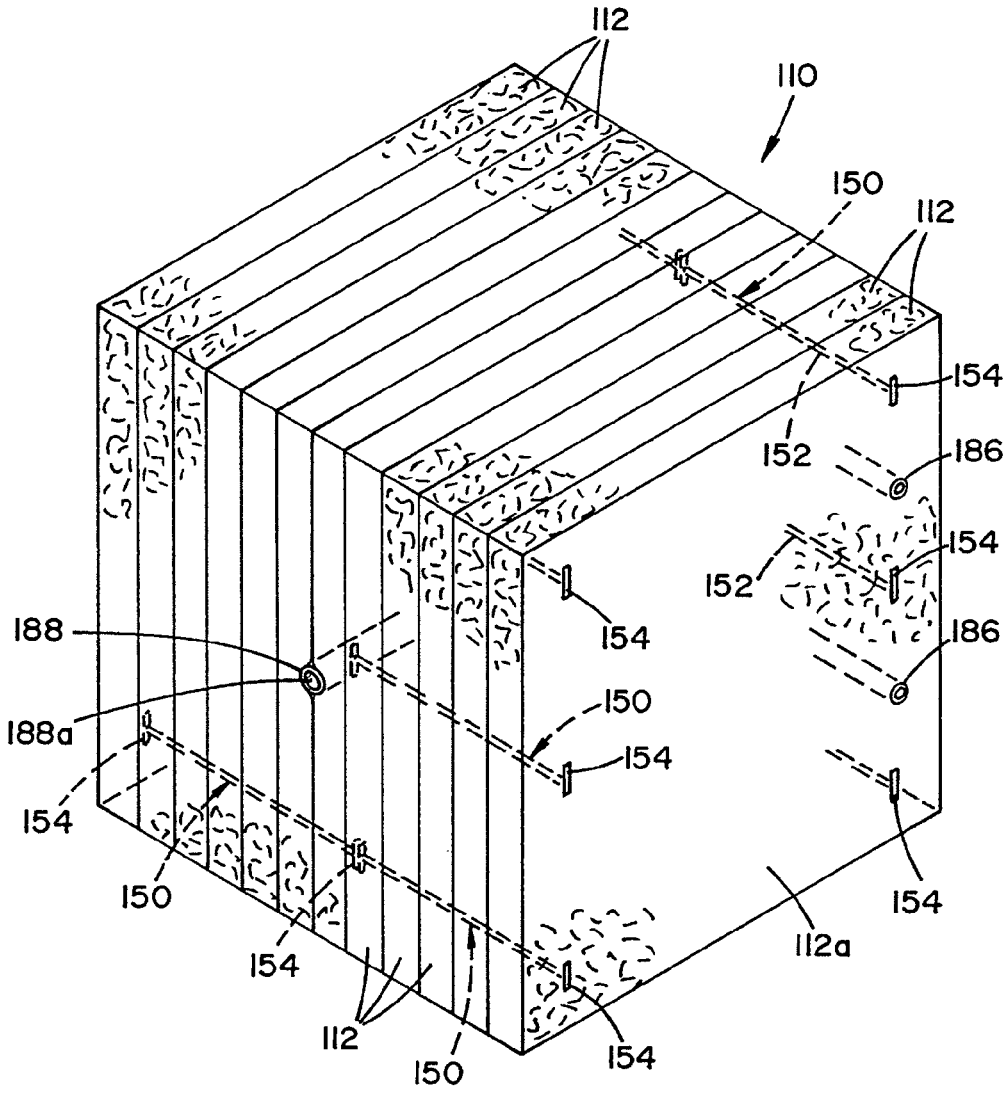
FIG. 3 is a perspective view of a refractory module, illustrating a preferred embodiment of the present invention.

Referring now to FIG. 3, a refractory fiber module 110 illustrating a preferred embodiment of the present invention is shown. Refractory module 110 is comprised of a plurality of like-shaped layers 112 of a refractory blanket or mat. In the embodiment shown, each layer 112 of the refractory blanket or mat is formed of a fibrous refractory material such as, by way of example and not limitation, chromia-alumina-silica, alumina-silica, alumina-silica-zirconia, soluble fibers, mullite fibers, alumina fibers or zirconia. In a preferred embodiment, a low-iron, high-purity ceramic fiber blanket sold by A.P. Green Industries under the trademark INSWOOL® is used to form refractory layers 112. In the embodiment shown, twelve (12) like-shaped layers 112 of refractory fiber blanket are assembled to form refractory module 110. Each layer 112 has a thickness of about one (1) inch, and module 110 measures about twelve (12) inches by twelve (12) inches by twelve (12) inches. As will be appreciated by those skilled in the art, the number of layers 112 may vary based upon the thickness of the blanket or mat used to form layers 112. In another embodiment, eight (8) layers that are twelve (12) inches by twelve (12) inches by one and one-half (1½) are used to form a twelve (12) inch cubic module 110.

Figure 4:
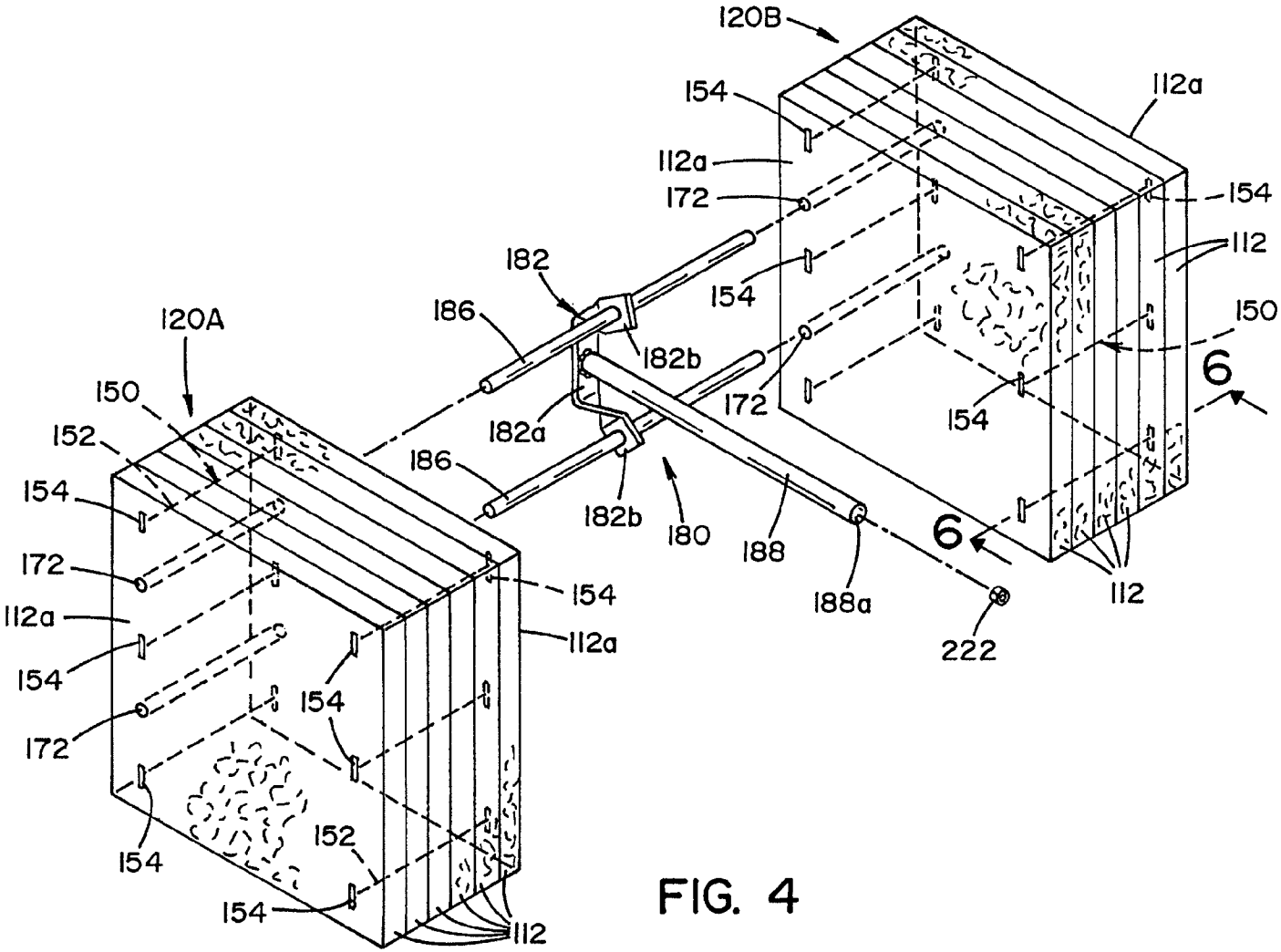
FIG. 4 is an exploded view of the module shown in FIG. 3, showing a support structure embedded between sections of the module.

According to one aspect of the present invention, refractory module 110 is comprised of at least two module sections or "loafs" 120A, 120B, as best seen in FIG. 4. Each module section 120A, 120B is comprised of two or more layers 112 of the refractory mat or blanket. In the embodiment shown, refractory module 110 is comprised of two module sections 120A, 120B, and each module section 120A, 120B is comprised of six (6) layers 112. It is also contemplated that module 110 may be comprised of more than two module sections. For example, module 110 may also be comprised of four (4) module sections wherein each module section is comprised of three (3) layers 112 of ceramic material. Layers 112 in each module section 120A, 120B are held together by plastic fasteners 150 that extend through layers 112. In the embodiment shown, plastic fastener 150 extends through all of layer 112 that form a module section 120A, 120B.

Each plastic fastener 150 is, basically, comprised of an elongated body portion 152 in the form of a plastic fiber or filament and end sections 154 that extend outwardly from body portion 152. In the embodiment shown, plastic fasteners 150 have T-shaped end sections 154. Plastic fasteners 150 have an overall length approximately equaling the thickness of the multiple layers 112 of the refractory material forming a module section 120A or 120B, such that layers 112 are held together side-by-side to form a cubic module section 120A or 120B. As best seen in FIG. 4, plastic fasteners 150 are disposed along the periphery of module sections 120A, 120B to hold the edges of refractory layers 112 together.

Figure 8:
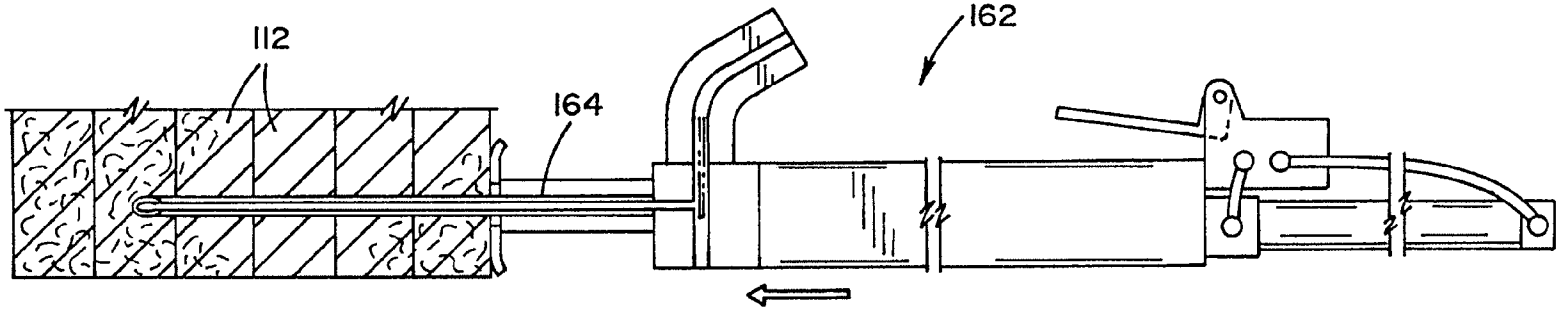
FIG. 8 is a schematic illustration of a fastening device for attaching multiple layers of ceramic material.
Figure 9:
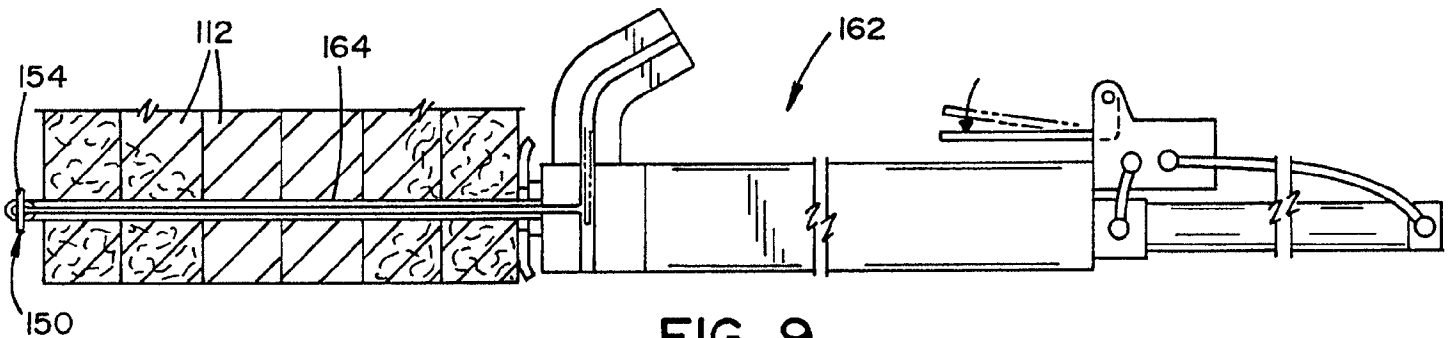
FIG. 9 is a schematic view, showing a plastic fastener being inserted through a plurality of ceramic layers for attaching a plastic fastener.
Figure 10:
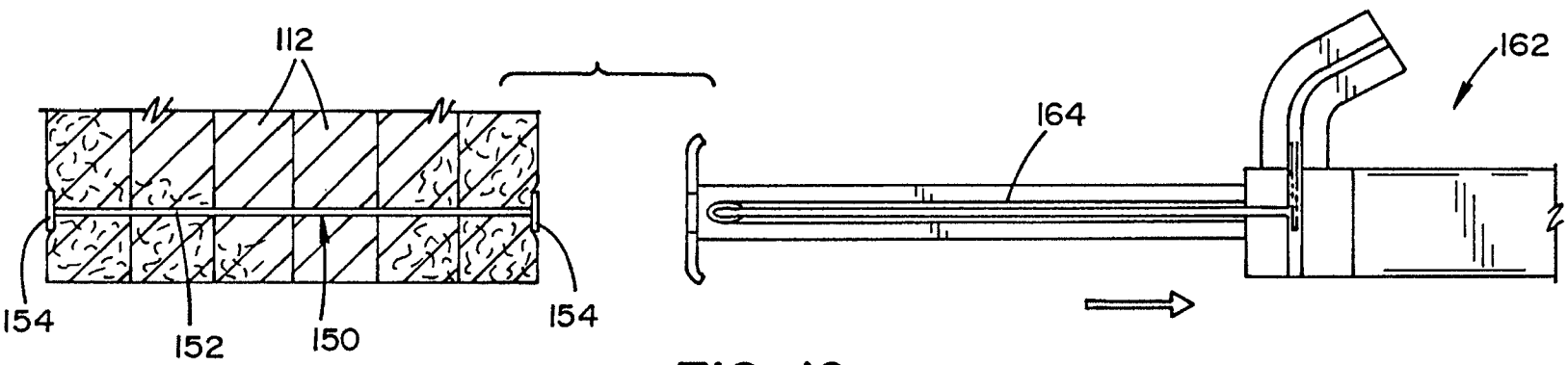
FIG. 10 is a schematic view, showing the attaching device removed from the layers of ceramic material, leaving a plastic fastener extending through the plurality of layers of ceramic material and securing such layers together.

Referring now to FIGS. 8-10, a method of forming the module sections is schematically illustrated. Basically, the method of forming the refractory module and, more specifically, each module section comprises the steps of assembling like-sized layers 112 of a ceramic mat or blanket together side-by-side, as shown in FIG. 4. Layers 112 of ceramic material are fastened together by forcing the elongated plastic fasteners 150 through layers 112 of refractory material. A fastener-injecting device 162 (shown in FIGS. 8-10) is used to insert fasteners 150 into module sections 120A, 120B. Fastener-injecting device 162 in and of itself forms no part of the present invention and is a conventionally known device for attaching plastic fasteners of the type heretofore described into layers of fabrics.

Figure 6:
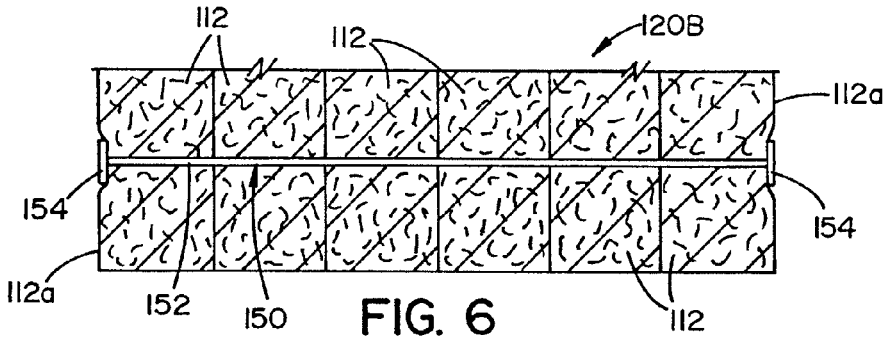
FIG. 6 is an enlarged sectional view taken along the lines 6-6 of FIG. 4.

Fastener-injecting device 162 includes an elongated needle 164 that is dimensioned to penetrate through layers 112 of ceramic material. In accordance with the present invention, it was found that, by modifying a conventionally known fastener-injecting device to lengthen the penetrating needle and by using longer plastic fasteners 150, a plurality of layers 112 of refractory blanket or mat may be easily held together. Plastic fasteners 150 of the type heretofore described are generally known and used in the garment industry for attaching tags and labels onto garments. Needle 162 carries plastic fasteners 150, such that one end section 154 of plastic fastener 150 extends to the opposite face of a module section 120A, 120B. End section 154 of plastic fasteners 150 is then released from needle 164, and needle 164 is withdrawn from layers 112 of refractory mat. Plastic fastener 150 is released from needle 164, thereby attaching layers 112 together. As best seen in FIG. 6, end sections 154 of plastic fastener 150 engage the outward-facing surfaces 112*a* of layer 112 of refractory section 120B, thereby holding plastic fastener 150 in position and maintaining layers 112 together. Needle 164 is withdrawn from layers 112, leaving plastic fastener 150 holding the plurality of layers 112 together.

Figure 7:
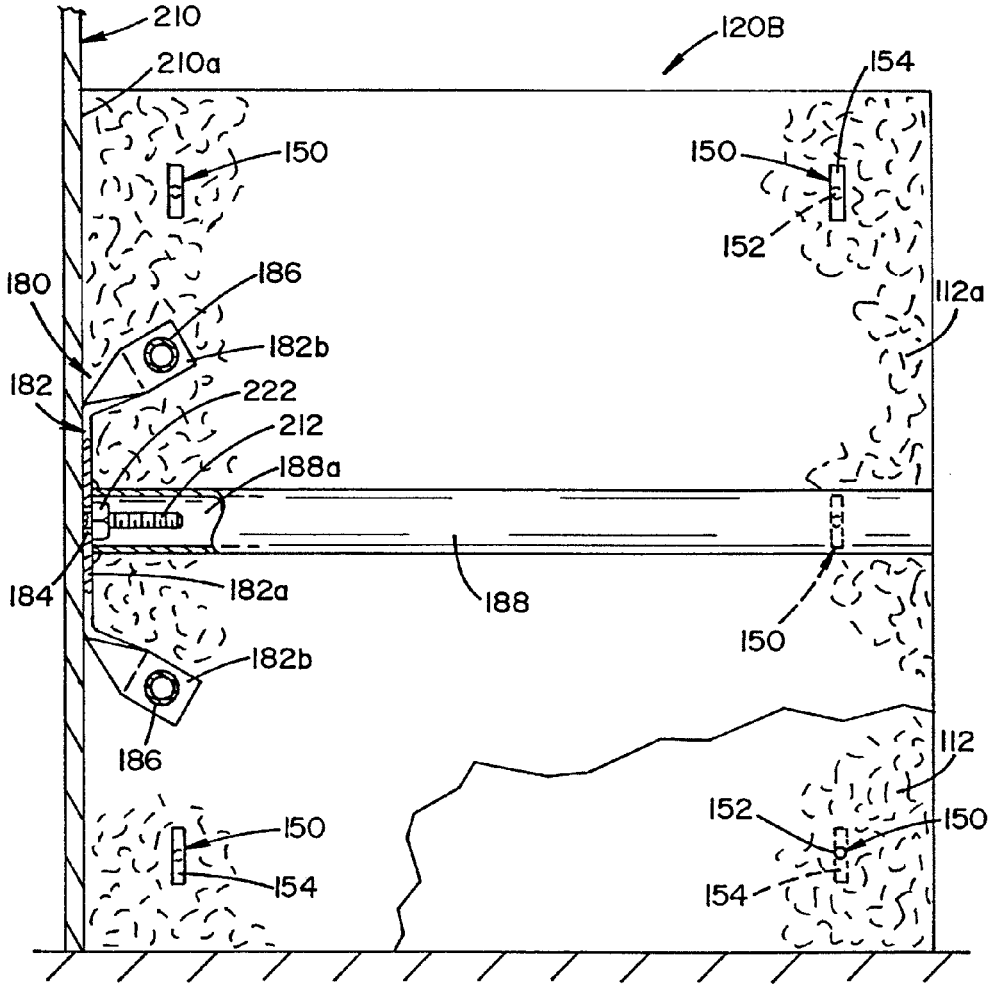
FIG. 7 is a sectional view of a refractory module, showing a support structure within the module that mounts the module to an inner surface of a furnace.

Spaced-apart holes 172 are then formed through each module section 120A, 120B, as best seen in FIG. 4. Holes 172 are disposed along one edge of module sections 120A, 120B. Holes 172 are dimensioned and adapted for mounting module sections 120A, 120B onto an anchor assembly 180 that is best seen in FIG. 4. Anchor assembly 180 is comprised of a bracket or yoke or anchor 182. Anchor 182 includes an intermediate base portion 182*a* and opposed arm portions 182*b*. Base portion 182 is generally flat. A mounting opening 184 (best seen in FIG. 7) is formed in base portion 182*a* at its midpoint. Arm portions 182*b* of anchor 182 are bent to one side of planar base portion 182*a* of anchor 182. Arm portions 182*b* are also twisted 90°, so that arm portions 182*b* are in a common plane that is normal to the plane of base portion 182*a*, as best seen in FIG. 7. Anchor bars or tubes 186 extend through each arm portion 182*b*. Bars or tubes 186 are generally parallel to each other. Anchor 182 and bars or tubes 186 are formed of a corrosion-resistant steel (e.g., stainless steel) or any metal alloy or other material possessing suitable corrosion- and heat-resistant properties.

Tubes 186 have a length to allow them to extend into holes 172 that are formed in module sections 120A, 120B, as illustrated in FIG. 4. In this respect, refractory module 110 is formed by sliding each module section 120A, 120B onto anchor assembly 180, as illustrated in FIG. 4. As best seen in FIGS. 4 and 7, an elongated tube member 188 projects from base portion 182*a* of anchor 182. Tube member 188 defines an inner passage 188*a* and is disposed with passage 188*a* in alignment with mounting opening 184 in base portion 182*a* of anchor 182. Tube member 188 has a length such that, when module sections 120A, 120B are mounted onto anchor assembly 180, the free end of tube member 188 is disposed near the ends of layers 112 of ceramic blanket, forming module sections 120A, 120B. In other words, the end of tube member 188 extends to near the surface of an assembled refractory module 110, as shown in FIG. 3. In a preferred embodiment, tube member 188 is about one (1) inch shorter than module 110. In the twelve (12) inch cubic modules heretofore described, tube member 188 is about eleven (11) inches long.

With plastic fasteners 150 holding layers 112 of the ceramic blanket that form module sections 120A, 120B together, each module section 120A, 120B is generally rigid and self-supporting. When module sections 120A, 120B are mounted onto mounting tubes 186 of anchor assembly 180, the resulting refractory module is generally rigid and self-supporting, with plastic fasteners 150 maintaining the edges of layers 112 of ceramic blanket together.

Figure 5:
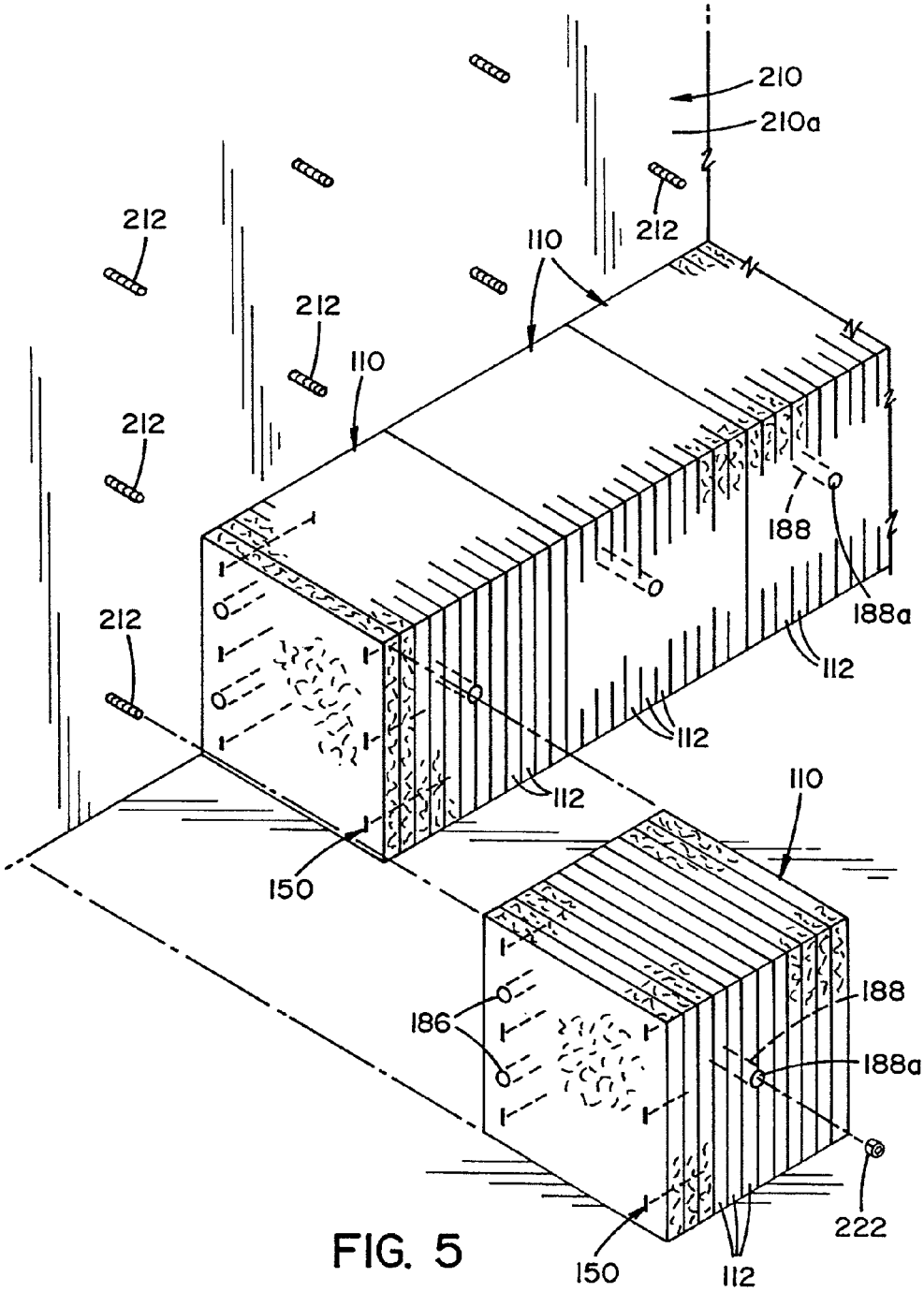
FIG. 5 is a perspective view, illustrating a method of mounting a refractory module shown in FIG. 3 to an inner surface of a furnace wall.

Referring now to the use of refractory module 110, a refractory module formed as heretofore described is shipped to a job site. Additional banding or wrapping of module 110 is not required, since plastic fasteners 150 maintain each module section 120A, 120B together as a rigid structure. With each module section 120A, 120B being mounted on anchor assembly 180, relative movement of layers 112 and module sections 120A, 120B is restricted, thereby resulting in a stable block-like structure. Refractory modules 110 are designed to be mounted to an inner surface 210*a* of a furnace wall 210, best seen in FIG. 5. A plurality of spaced-apart, threaded studs 212 is attached to inner surface 210*a* of furnace wall 210, as best seen in FIG. 5. Studs 212 are preferably welded to inner surface 210*a* of refractory wall 210 at predetermined spacing. Refractory modules 110 are mounted onto furnace wall 210 by positioning a refractory module 110 relative to furnace wall 210, such that threaded studs 212 on furnace wall 210 extends through mounting opening 184 in base portion 182*a* of anchor 182. A conventional fastener 222, i.e., a nut, is applied through passage 188*a* in tube member 188, using an elongated wrench, and secures anchor assembly 180 to furnace wall 210*a* which, in turn, secures refractory module 110 to furnace wall 210, as illustrated in FIG. 7. In a similar fashion, other refractory modules 110 are mounted to furnace wall 210, as illustrated in FIG. 5, until inner surface 210*a* of wall 210 is covered by refractory modules 110.

The present invention provides a refractory module 110 that is easy to manufacture and may be quickly installed onto inner surface 210*a* of furnace wall 210. In accordance with one aspect of the present invention, plastic fasteners 150 that maintain layers 112 of refractory mats together in each refractory module 110 need not be removed during installation and use of modules 110. In this respect, unlike refractory module 10 shown in FIG. 1, a module according to the present invention does not require removal of bands or cardboard panels or plastic packaging prior to use of the module on the furnace wall. A refractory module 110 according to the present invention substantially reduces installation time and, at the same time, significantly reduces job-site waste material that must be disposed of. Still further, because refractory modules 110 do not include metallic wires or clips to hold layers 112 of refractory mats together, the likelihood of injury to workers, namely, puncture wounds and cuts during installation and removal of the modules, is essentially eliminated.

The present invention thus provides a refractory module 110 that can be quickly assembled into a stable, self-supporting configuration, which configuration does not require additional packaging. Module 110 can be quickly installed and removed from a furnace wall without generating excessive waste material at the job site or potential of injury to a worker.

In the embodiments discussed heretofore, insulating block 10 is comprised of a plurality of module sections, wherein the ceramic layers 112 of each module section are held together by plastic fasteners that extend through all the ceramic layers forming the module section.

Figure 11:
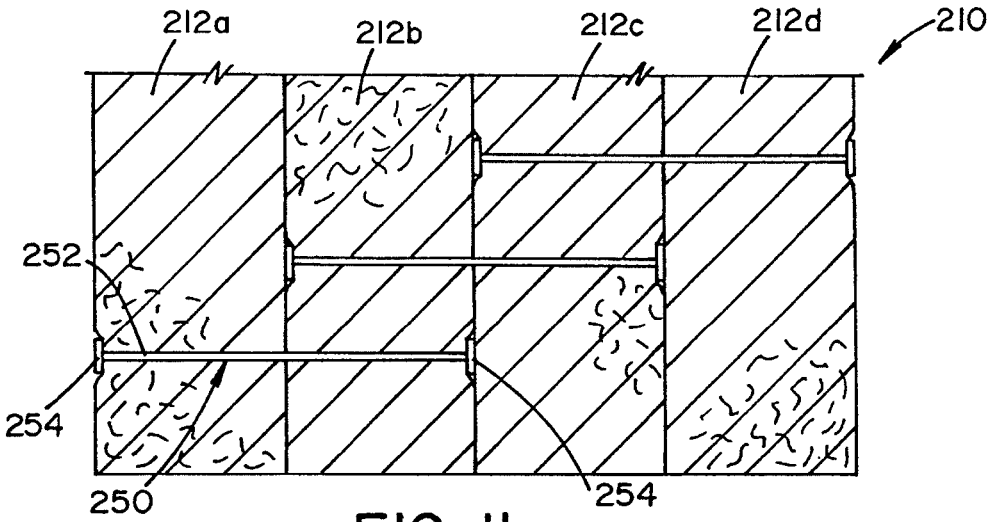
FIG. 11 is a sectional view of layers of ceramic material illustrating another structure and method of assembling an insulating block.

FIG. 11 illustrates an alternate embodiment of the present invention wherein an insulating block or module section is formed by attaching two or more ceramic layers together with plastic fasteners to form a group of layers, and then attaching additional ceramic layers to the group with additional plastic fasteners. In FIG. 11, a module section 210 is comprised of four (4) ceramic layers 212*a*, 212*b*, 212*c* and 212*d*. Plastic fasteners 250 attach layer 212*a* to 212*b*. In the embodiment shown, fasteners 250 have a length approximately equal to the thickness of two (2) layers 212*a*, 212*b*, 212*c*, 212*d*. Layer 212*c* is attached to layer 212*b* by a fastener 250. In turn, layer 212*d* is attached to the group of ceramic layers by a plastic fastener 250 attaching layer 212*d* to layer 212*c*. FIG. 11 illustrates how plastic fasteners that may not be long enough to extend through all the ceramic layers of a module section or an insulating block may be used to form such module section or insulating block.

Figure 12:
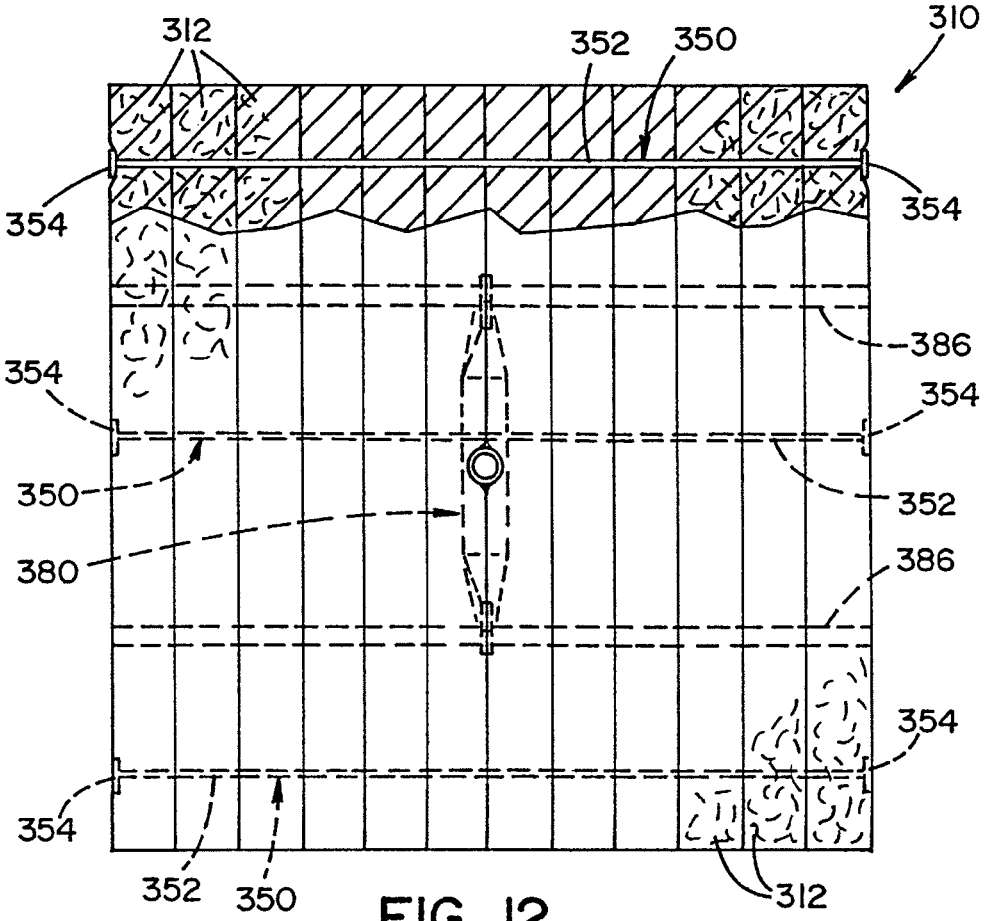
FIG. 12 is a partially-sectioned view of an insulating block showing plastic fasteners that are dimensioned to extend through all of the ceramic layers that form the insulating block.

Referring now to FIG. 12, an insulating block 310 illustrating another embodiment of the present invention is shown. Insulating block 310 is comprised of a plurality of layers 312 of ceramic blanket mounted onto tubes or bars 386 of an anchor assembly 380. In the embodiment shown, plastic fasteners 350 have an elongated fiber portion 352 and end section 354, and attach all of layer 312 that form insulating block 310 together. In this respect, plastic fasteners 350 are dimensioned such that a single plastic fastener 350 can extend through all of layers 312 that form insulating block 310.

FIGS. 11 and 12 thus illustrate how module sections and insulating blocks may be formed using plastic fasteners 150, 250, 350 of different lengths. It should also be appreciated that because of the fibrous nature of the ceramic layers, one end section of the plastic fastener may be disposed within the fibrous ceramic layers and be captured therein by the fibrous material. In other words, it is not necessary for both end sections of a plastic fastener to be disposed on an outer surface of a ceramic layer for the end section of a plastic fastener to capture a ceramic layer. One or both ends of a plastic fastener may be embedded within a layer of ceramic material.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. An insulating block for lining an interior surface of a furnace wall, said block comprised of:

at least two insulating module sections, each module section formed from two or more layers of a ceramic (material) blanket, said layers of said ceramic blanket held together by one or more elongated plastic fasteners, each plastic fastener consisting of an elongated filament having end sections that extend outwardly from each end of said filament, said elongated filament dimensioned to extend at least partially through at least two of said layers and said enlarged end sections dimensioned to engage said layers, wherein said layers of blanket are held together side-by-side by said plastic fasteners; and a support member having at least one anchor rod (tube) affixed thereto, said insulating module sections being mounted on said anchor rod.

2. An insulating block as defined in claim 1, wherein said layers of ceramic blanket are formed of a material selected from chromia-alumina-silica, alumina-silica, alumina-silica-zirconia, soluble fibers, mullite fibers, alumina fibers or zirconia.

3. An insulating block as defined in claim 1, wherein said layers of ceramic blanket are formed of alumina-silica-zirconia.

4. An insulating block as defined in claim 1, wherein said plastic fasteners are disposed about the periphery of module sections.

5. A refractory module formed from two or more layers of a ceramic (material) blanket, said layers of said ceramic blanket held together by one or more plastic fasteners, each plastic fastener comprised of an elongated filament having end sections that extend outwardly from said elongated filament, said elongated filament dimensioned to extend at least partially through at least two of said layers and enlarged end sections dimensioned to engage said at least two of said layers, said filament having a predetermined length wherein said layers of blanket are held together side-by-side by said plastic fasteners.

6. A refractory module as defined in claim 5, wherein said layers of ceramic blanket are formed of a material selected from chromia-alumina-silica, alumina-silica, alumina-silica-zirconia, soluble fibers, mullite fibers, alumina fibers or zirconia.

7. A refractory module as defined in claim 5, wherein said layers of ceramic blanket are formed of alumina-silica-zirconia.

8. A refractory module as defined in claim 5, wherein at least one end section of a plastic fastener is disposed on a surface of a layer of said ceramic blanket.

9. A refractory module as defined in claim 5, wherein at least one end section of a plastic fastener is embedded within a layer of said ceramic blanket.

10. A refractory module as defined in claim 5, wherein said plastic fastener extends through all said layers.

11. An insulating block for lining an interior surface of a furnace wall, said block comprised of:

a support member having at least one elongated anchor rod attached thereto; and a plurality of layers of a ceramic blanket mounted on said anchor rod, said layers held together side-by-side by one or more plastic fasteners, each plastic fastener consisting of an elongated filament having end sections that extend outwardly from said elongated filament, said elongated filament dimensioned to extend at least partially through at least two of said ceramic layers and enlarged end sections dimensioned to engage said layers, wherein said ceramic layers are held together side-by-side by said plastic fastener.

12. An insulating block as defined in claim 11, wherein said plastic fasteners extend through all of the layers of ceramic material forming said insulating block and said enlarged end sections of said plastic fasteners are disposed on the outer surfaces of said insulating block.

13. An insulating block as defined in claim 11, wherein said insulating block is comprised of at least two module sections, each module section being formed from two or more layers of ceramic blanket, said layer of ceramic blanket being held together by one or more plastic fasteners.

14. An insulating block as defined in claim 13, wherein said plastic fasteners extend through all of said ceramic layers of a module section.

15. An insulating block as defined in claim 10, wherein said enlarged end section of said plastic fasteners are disposed on the outer side surfaces of said layers.

16. A method of assembling a refractory module from layers of a ceramic material, comprising the steps of:

assembling like-sized layers of a ceramic material together side-by-side;

securing said layers together into a module section by forcing elongated plastic fasteners through an elongated tubular needle extending through said layers of material, each of said fasteners consisting of an elongated filament having end sections that extend outwardly from said filament, said elongated filament dimensioned to extend at least partially through at least two layers and said enlarged end sections engaging said layers of ceramic material to hold said layers of ceramic material together side-by-side by said enlarged end sections capturing said layers.

17. A method as defined in claim 16, wherein said layers of ceramic blanket are formed of a material selected from chromia-alumina-silica, alumina-silica, alumina-silica-zirconia, soluble fibers, mullite fibers, alumina fibers or zirconia.

18. A method as defined in claim 16, wherein said layers of ceramic blanket are formed of alumina-silica-zirconia.

19. A method as defined in claim 16, wherein said plastic fasteners are disposed about the periphery of module sections.

20. A method as defined in claim 16, further comprising the step of:

mounting said module sections onto an anchor rod on an anchor assembly.

21. A method as defined in claim 16, wherein opposite-facing surfaces of said layers are the outer side surfaces of said layers.

* * * * *